US006262683B1

(12) United States Patent
Kawahata et al.

(10) Patent No.: US 6,262,683 B1
(45) Date of Patent: Jul. 17, 2001

(54) CIRCULARLY POLARIZED WAVE ANTENNA AND WIRELESS APPARATUS

(75) Inventors: Kazunari Kawahata, Machida; Shigekazu Itoh, Sagamihara, both of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/531,382

(22) Filed: Mar. 21, 2000

(30) Foreign Application Priority Data

Jun. 16, 1999 (JP) ..... 11-169613

(51) Int. Cl.[7] ..... H01Q 1/38
(52) U.S. Cl. ..... 343/700 MS; 343/702
(58) Field of Search ..... 343/700 MS, 702; 455/90

(56) References Cited

U.S. PATENT DOCUMENTS 5,243,353 * 9/1993 Nakahara et al. ..... 343/700 MS
5,410,322 * 4/1995 Sonoda ..... 343/700 MS
6,040,806 * 3/2000 Kushihi et al. ..... 343/853

* cited by examiner

*Primary Examiner*—Don Wong
*Assistant Examiner*—James Clinger
(74) *Attorney, Agent, or Firm*—Ostrolenk, Faber, Gerb & Soffen, LLP

(57) ABSTRACT

A circularly polarized wave antenna for transmitting/receiving circularly polarized radio waves by a radiative electrode disposed on a dielectric member, wherein: the dielectric member is substantially cylindrical; the radiative electrode has a substantially circular shape, which is similar to the shape of a top surface of the dielectric member, and is disposed on the top surface of the dielectric member; a spacing between an outer peripheral edge of the top surface of the dielectric member and an edge of the radiative electrode is formed so as to be substantially the same around the entirety of the outer peripheral edge of the dielectric member; the circularly polarized wave antenna excites a higher mode; and a feed electrode, which supplies electrical power to said radiative electrode by capacitive coupling, is disposed on a side of the dielectric member.

22 Claims, 8 Drawing Sheets

CIRCULARLY POLARIZED WAVE ANTENNA AND WIRELESS APPARATUS

BACKGROUND OF THE INVENTION

1. Field of the Invention

The present invention relates to circularly polarized wave antennas for transmitting/receiving circularly polarized radio waves and wireless apparatus using the same.

2. Description of the Related Art

In FIG. 12A, an example of a conventional circularly polarized wave antenna included in a wireless apparatus is schematically shown. In FIG. 12B, a sectional view taken along the line a—a of FIG. 12A is shown. A circularly polarized wave antenna 1 shown in FIGS. 12A and 12B includes a dielectric member 2 of a rectangular prism shape. On the top surface of the dielectric member 2, a circular radiative electrode 3 is formed. Also, the dielectric member 2 is provided with through holes from the top surface to the bottom surface. Feed pins P are inserted into the through holes. The feed pins P are formed such that electrical power is supplied thereto from the outside. When electrical power is supplied from the outside to the radiative electrode 3 through the feed pins P, the radiative electrode 3 is excited in, for example, two directions, i.e., the a—a axis direction and the b—b axis direction (specifically, the direction intersecting the a—a axis direction at an angle of 45°), as shown in FIG. 12A.

The circularly polarized wave antenna 1 shown in FIGS. 12A and 12B can transmit/receive circularly polarized radio waves by exciting the radiative electrode 3, as described above.

With the construction shown in FIGS. 12A and 12B, when the relative dielectric constant of the dielectric member 2 is increased so as to miniaturize the circularly polarized wave antenna 1, and therefore the dielectric member 2, the axial ratio deteriorates when the circularly polarized wave antenna 1 is operated in a higher mode.

As described above, the circularly polarized wave antenna 1 is structured such that the radiative electrode 3 is excited in two directions meeting at a 45° angle. As shown in FIGS. 12A and 12B, when the radiative electrode 3 is formed on the top surface of the rectangular-prism dielectric member 2, for example, a spacing d1 in the a—a axis direction between an outer peripheral edge of the dielectric member 2 and an edge of the radiative electrode 3 is greater than a spacing d2 in the b—b axis direction between an outer peripheral edge of the dielectric member 2 and an edge of the radiative electrode 3. Hence, the spacing between the outer peripheral edge of the dielectric member 2 and the edge of the radiative electrode 3 is different for each excitation direction of the radiative electrode 3. As described above, when the relative dielectric constant of the dielectric member 2 is high, the difference in the spacing causes differences in edge effects, thus failing to match the resonant frequencies of the two excitation directions in the radiative electrode 3. As a result, a problem arises in that the axial ratio deteriorates when the circularly polarized wave antenna 1 is operated in a higher mode.

The circularly polarized wave antenna shown in FIGS. 12A and 12B is structured such that electrical power is supplied to the discharge electrode 3 using the feed pins P so as to excite the discharge electrode 3. When the feed pins P are used in this manner, it is difficult to match the resonant frequencies of the two excitation directions in the radiative electrode 3.

In addition, the circularly polarized wave antenna shown in FIGS. 12A and 12B has problems as described below. A circuit board on which the circularly polarized wave antenna 1 is to be mounted is provided with a circuit section for driving the circularly polarized wave antenna 1. In order to miniaturize the circuit board, the circuit section is occasionally disposed on the surface opposite to the surface on which the circularly polarized wave antenna 1 is to be mounted. In the circularly polarized wave antenna 1 shown in FIGS. 12A and 12B, the feed pins P are disposed near the center of the dielectric member 2. As described above, when the circuit section is provided on the opposite side of the circuit board, it is difficult to satisfactorily provide a conductive connection between the feed pins P of the circularly polarized wave antenna 1 and the circuit section. Also, patterning of the circuit section is difficult.

SUMMARY OF THE INVENTION

To overcome the above described problems, preferred embodiments of the present invention provide a circularly polarized wave antenna capable of operating in a higher mode and a wireless apparatus comprising the same.

One preferred embodiment of the present invention provides a circularly polarized wave antenna for transmitting/receiving circularly polarized radio waves by a radiative electrode disposed on a dielectric member, wherein the dielectric member is substantially cylindrical; the radiative electrode has a substantially circular shape, which is similar to the shape of a top surface of the dielectric member, and is disposed on the top surface of the dielectric member; a spacing between an outer peripheral edge of the top surface of the dielectric member and an edge of the radiative electrode is formed so as to be substantially the same around the entirety of the outer peripheral edge of the dielectric member; the circularly polarized wave antenna excites a higher mode; and a feed electrode, which supplies electrical power to the radiative electrode by capacitive coupling, is disposed on a side of said dielectric member.

In the above described circularly polarized wave antenna, a feed-electrode-disposing region on the side of the dielectric member may be formed to be planar; and the feed electrodes may be disposed on the plane.

In the above described circularly polarized wave antenna, the edge of the radiative electrode may be disposed inside the outer peripheral edge of the top surface of the dielectric member; and the feed electrodes may be disposed in a region between the outer peripheral edge of the dielectric member and the edge of the radiative electrode on the top surface of the dielectric member while being separated from the radiative electrode.

According to the above described structure and arrangement, a dielectric member is substantially cylindrical, and a substantially-circular radiative electrode, which is similar to a top surface of the dielectric member, is disposed on the top surface of the dielectric member. Therefore, the spacing between an outer peripheral edge of the top surface of the dielectric member and an edge of the radiative electrode is substantially the same around the entire periphery. When the circularly polarized wave antenna is operated in a higher mode, differences in edge effects are prevented from occurring, and the resonant frequencies of two excitation directions in the radiative electrode are thereby matched. Therefore, circularly polarized radio waves in a higher mode are ensured to be transmitted/received by the radiative electrode.

Furthermore, the axial ratio in a higher mode is improved, and a bandwidth in the higher mode is sufficiently broadened.

In a circularly polarized wave antenna in which feed electrodes are disposed on a side or a top surface of the substantially-cylindrical dielectric member, trimming of the feed electrodes is easy. Thus, shifting in the resonant frequencies of the excitation in the radiative electrode, which results from print quality of the feed electrodes, can be easily adjusted by trimming the feed electrodes. In particular, when the feed electrodes are formed on the top surface of the dielectric member, the feed electrodes can be trimmed in an easier manner. As described above, since the trimming of the feed electrodes is easily performed, the resonant frequencies of the two excitation directions in the radiative electrode can be matched more accurately. Thus, a sensitive circularly polarized wave antenna can be provided.

In a circularly polarized wave antenna in which a feed-electrode-disposing region on the side of the dielectric member is made planar and the feed electrodes are formed on that plane, the feed electrodes can be easily formed by a printing technique.

Another preferred embodiment of the present invention provides a wireless apparatus comprising the above described circularly polarized wave antenna.

Such wireless apparatus has an advantage that information is obtained at a lower error rate.

Other features and advantages of the present invention will become apparent from the following description of the invention which refers to the accompanying drawings.

DETAILED DESCRIPTION OF EMBODIMENTS OF THE INVENTION

Figure 1:
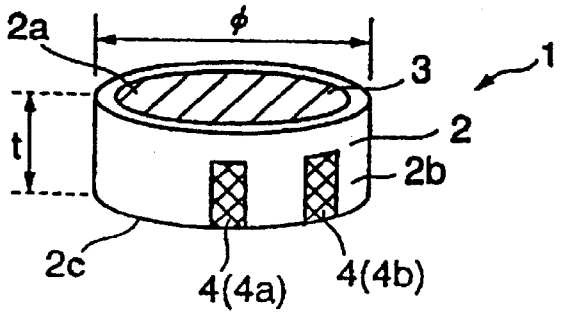
FIG. 1 is an illustration of a characteristic circularly polarized wave antenna in a first embodiment.
Figure 2:
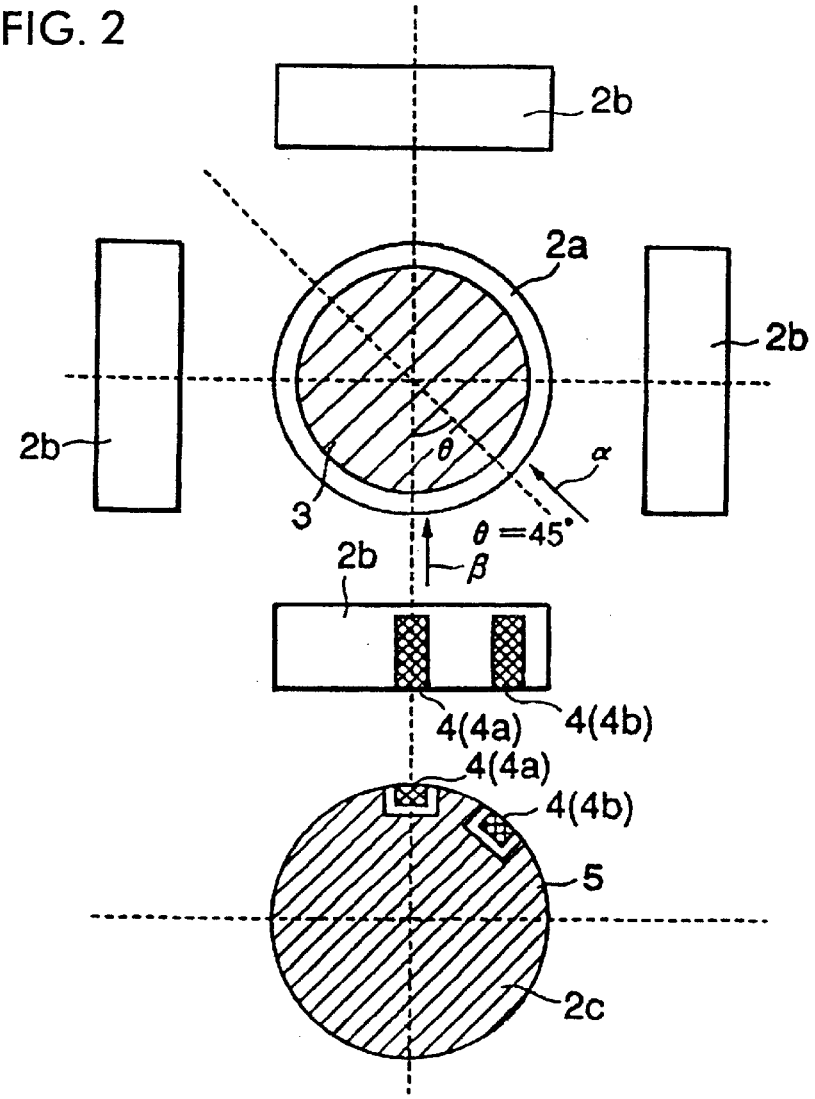
FIG. 2 illustrates states in which the circularly polarized wave antenna shown in FIG. 1 is seen from six directions, i.e., the top side, the bottom side, the front side, the back side, the right side, and the left side.

In FIG. 1, a perspective view of a circularly polarized wave antenna according to a first embodiment of the present invention is shown. In FIG. 2, states are shown in which the circularly polarized wave antenna shown in FIG. 1 is seen from six directions, i.e., from the top side, the bottom side, the front side, the back side, the right side, and the left side.

As shown in FIGS. 1 and 2, a circularly polarized wave antenna 1 of the first embodiment is a surface-mounting antenna, and includes a dielectric member 2. The dielectric member 2 is of a cylindrical shape, which is a distinctive shape. For example, the dielectric member 2 has a relative dielectric constant r of 21, a thickness t of 6 mm, and a diameter of 28 mm.

On a top surface 2*a* of the dielectric member 2, a radiative electrode 3 is formed by a printing technique or the like. The radiative electrode 3 is circular, which is similar to the shape of the top surface 2*a* of the dielectric member 2. The radiative electrode is formed such that the center position thereof corresponds to the center of the top surface 2*a*.

On a side 2*b* of the dielectric member 2, a pair of feed electrodes 4*a* and 4*b* is formed by a printing technique or the like. The feed electrodes 4*a* and 4*b* are disposed with a separation such that an $\alpha$ direction from the feed electrode 4*a* to the central axis of the dielectric member 2 and a $\beta$ direction from the feed electrode 4*b* to the central axis of the dielectric member 2 cross at a 45° angle. As shown in FIG. 2, the feed electrodes 4*a* and 4*b* are formed so as to wrap around the dielectric member 2 from the side 2*b* to a bottom surface 2*c*.

Furthermore, a ground electrode 5 is formed over substantially the entirety of the bottom surface 2*c* of the dielectric member 2 by a printing technique or the like, while being separated from the feed electrodes 4*a* and 4*b*.

Figure 3:
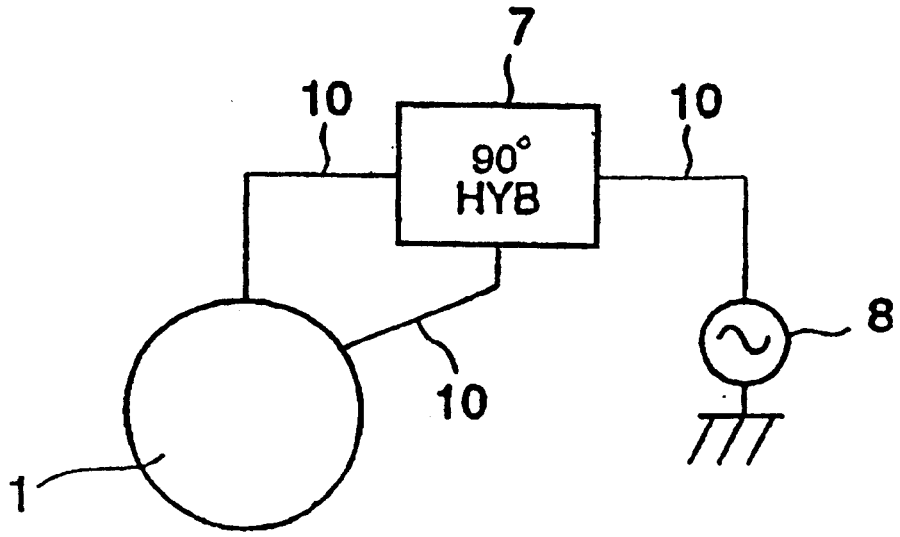
FIG. 3 is a circuit diagram of a circuit for driving the circularly polarized wave antenna shown in FIG. 1.

The circularly polarized wave antenna of the first embodiment is structured as above. In the circularly polarized wave antenna 1 of the first embodiment, the bottom surface 2*c* of the dielectric member 2 is a mounting surface. The circularly polarized wave antenna 1 is surface-mounted at a predetermined location on a circuit board with the mounting surface 2*c* facing the board. As shown in FIG. 3, a hybrid device (90° HYB) 7, an oscillator 8, and conductor patterns 10 are formed on the circuit board. By surface-mounting the circularly polarized wave antenna 1 on the circuit board, a circuit shown in FIG. 3 is formed.

In the circuit shown in FIG. 3, electrical power output from the oscillator 8 is conducted to the 90° hybrid device 7 through the conductor patterns 10. Based on this electrical power, the 90° hybrid device 7 distributes and supplies electrical power to each of the feed electrodes 4*a* and 4*b* of the circularly polarized wave antenna 1. The electrical power supplied to the feed electrode 4*a* and the electrical power supplied to the feed electrode 4*b* are out of phase by 90° from each other.

In the circularly polarized wave antenna 1, when the electrical power is supplied to the feed electrodes 4*a* and 4*b*, as described above, the electrical power is supplied from each of the feed electrodes 4*a* and 4*b* to the radiative electrode 3 by means of capacitive coupling. Based on this electrical power, the radiative electrode 3 is excited in two directions, the $\alpha$ direction and the $\beta$ direction, as shown in FIG. 2, and performs transmission/reception of circularly polarized radio waves.

According to the first embodiment, the dielectric member 2 is of a cylindrical shape. The circular radiative electrode 3, which is similar to the shape of the top surface 2*a* of the dielectric member 2, is disposed on the top surface 2*a* so that the center thereof substantially corresponds to the center of the top surface 2*a*. Therefore, the spacing between the outer peripheral edge of the top surface 2*a* and the edge of the radiative electrode 3 is substantially the same around the entire perimeter. When the circularly polarized wave antenna 1 is to be operated in a higher mode, differences in edge effects are prevented from occurring. The resonant frequencies of the two excitation directions in the radiative electrode 3 are thereby matched. Therefore, the circularly polarized wave antenna 1 can be operated in a higher mode with a satisfactory bandwidth.

In the first embodiment, since the feed electrodes 4*a* and 4*b* are formed on the side 2*b* of the dielectric member 2, the following advantages are obtained. For example, when the feed electrodes 4*a* and 4*b* are formed on the side 2*b* of the dielectric member 2 merely by the printing technique, the capacitance between the feed electrode 4*a* and the radiative electrode 3 is often different from the capacitance between the feed electrode 4*b* and the radiative electrode 3 due to a problem of print quality. In such a case where the capacitances are different, the resonant frequencies of the two excitation directions in the radiative electrode 3 are different due to the difference in the capacitances. By trimming the feed electrodes 4*a* and 4*b*, the capacitance between the feed electrode 4*a* and the radiative electrode 3 and the capacitance between the feed electrode 4*b* and the radiative electrode 3 are corrected so as to correspond with each other. Accordingly, the resonant frequencies of the two excitation directions in the radiative electrode 3 are adjusted. In the first embodiment, since the feed electrodes 4*a* and 4*b* are formed on the side 2*b* of the dielectric member 2, the feed electrodes 4*a* and 4*b* are easily trimmed. Specifically, adjustment of the resonant frequencies of the excitation in the radiative electrode 3 is easily performed.

Figure 4:
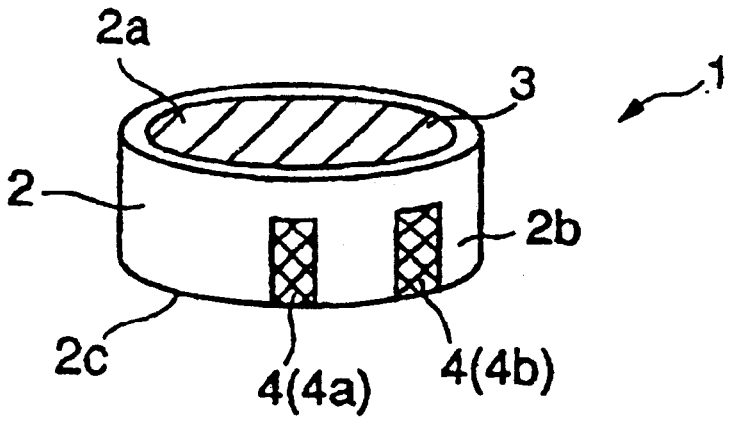
FIG. 4 is an illustration of a characteristic circularly polarized wave antenna in a second embodiment.
Figure 5:
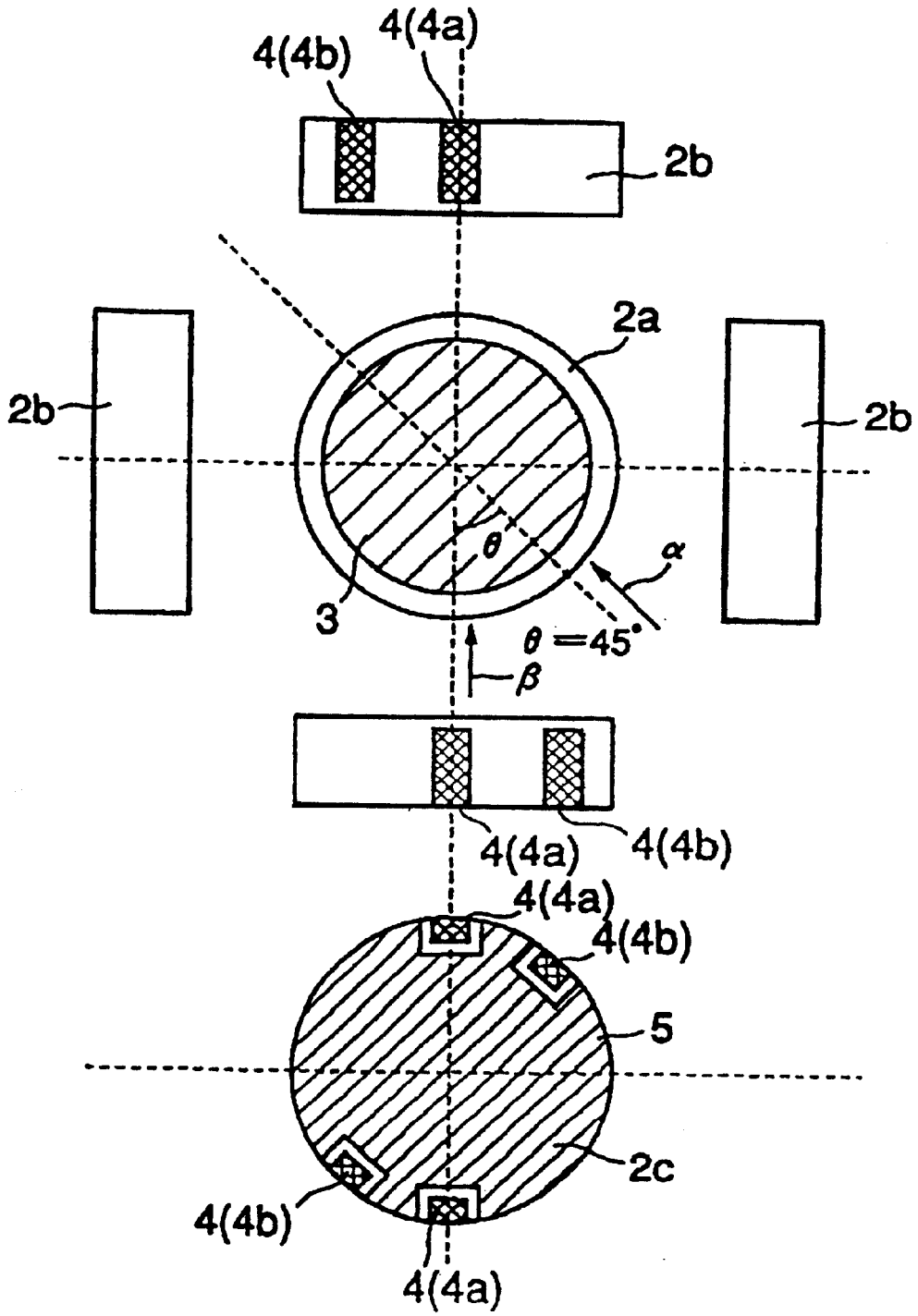
FIG. 5 illustrates states in which the circularly polarized wave antenna shown in FIG. 4 is seen from six directions, i.e., the top side, the bottom side, the front side, the bottom side, the left side, and the right side.

A second embodiment is described below. In FIG. 4, a perspective view of a circularly polarized wave antenna according to a second embodiment is shown. In FIG. 5, states are shown in which a circularly polarized wave antenna 1 shown in FIG. 4 is seen from six directions, i.e., from the top side, the bottom side, the front side, the back side, the right side, and the left side.

A characteristic feature of the second embodiment is that two sets of pairs of feed electrodes 4*a* and 4*b* are provided, as shown in FIGS. 4 and 5. The other construction is the same as that of the first embodiment. In the second embodiment, the same reference numerals are given to the same components as the first embodiment, and overlapping description of the common portions is omitted.

In the second embodiment, the feed electrodes 4*a* and 4*b*, which are grouped into a pair, are disposed with a separation, as in the first embodiment, so that directions from the feed electrodes 4*a* and 4*b* to the central axis of a dielectric member 2 each meet at a 45° angle. The two sets of pairs of feed electrodes 4*a* and 4*b* are disposed so as to oppose each other with the central axis of the dielectric member 2 therebetween.

Figure 6A:
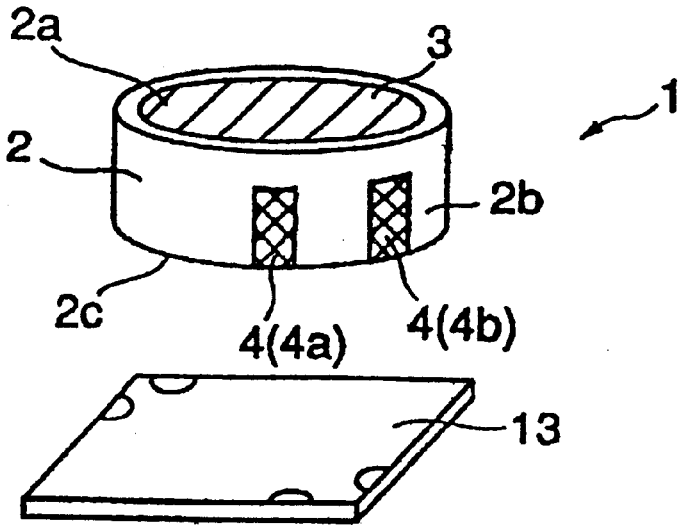
FIG. 6A and FIG. 6B include illustrations of an example of a circuit board on which the circularly polarized wave antenna shown in FIG. 4 is mounted and an example of mounting of the circularly polarized wave antenna.

The circularly polarized wave antenna 1 of the second embodiment is structured as described above. In the circularly polarized wave antenna 1 of the second embodiment, as in the first embodiment, a bottom surface 2*c* of the dielectric member 2 is a mounting surface. As shown in FIG. 6A the circularly polarized wave antenna 1 is surface-mounted on a circuit board 13 with the bottom surface 2*c* of the dielectric member 2 facing the board.

Figure 6B:
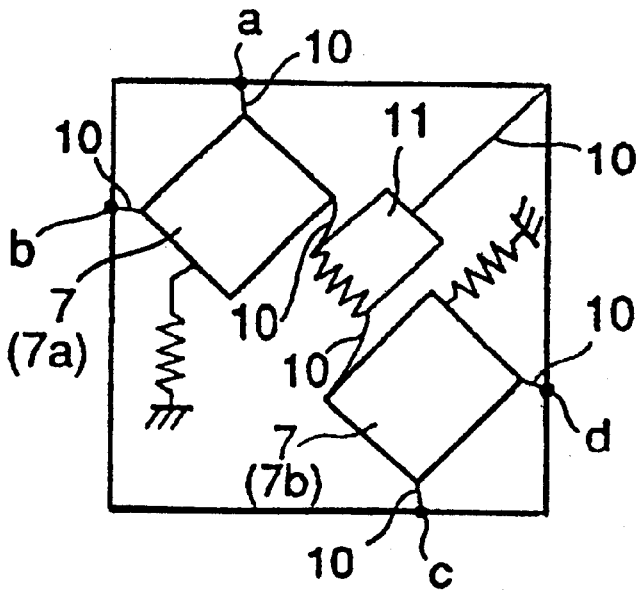

On the circuit board 13, a circuit section for driving the circularly polarized wave antenna 1 is provided on the back surface, which is opposite to the surface on which the circularly polarized wave antenna 1 is to be mounted. Specifically, on the back surface of the circuit board 13, as shown in FIG. 6B, 90° hybrid devices (90° HYB) 7*a* and 7*b*, an oscillator 8, conductor patterns 10, and a 0° hybrid device (0° HYB) 11 are formed. The circularly polarized wave antenna 1 is surface-mounted on the circuit board 13 so that the feed electrodes 4*a*, 4*b*, 4*a*, and 4*b* conduct and are connected to edges a, b, c, and d, respectively, of the conductor patterns 10, and a circuit shown in FIG. 7 is thereby formed.

Figure 7:
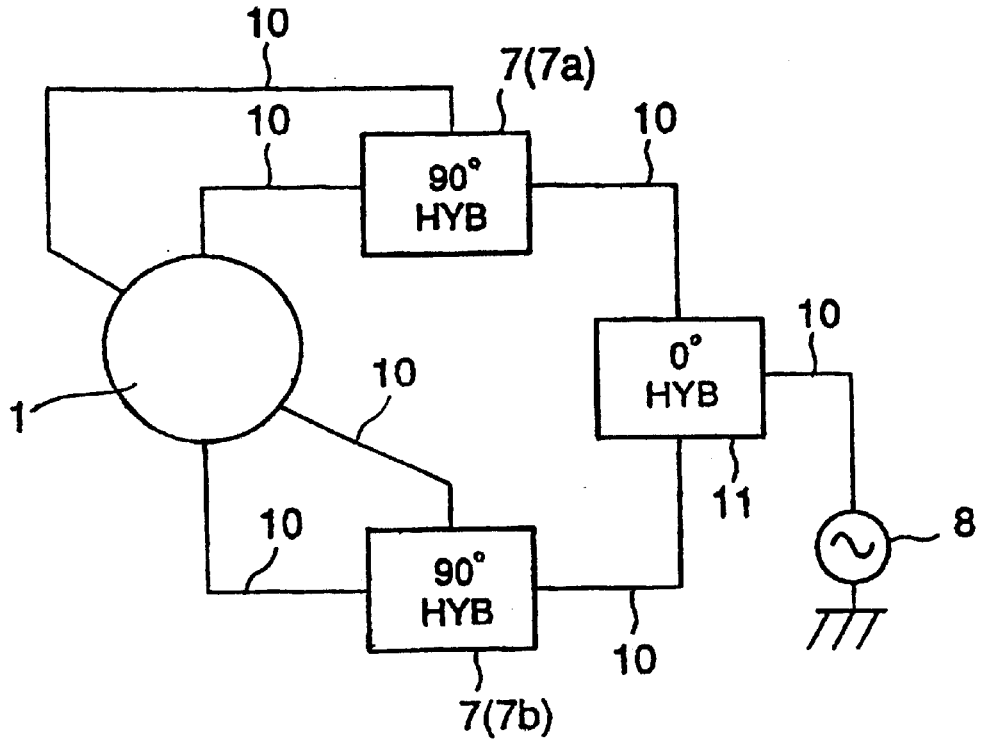
FIG. 7 is a circuit diagram of a circuit for driving the circularly polarized wave antenna shown in FIG. 4.

In the circuit shown in FIG. 7, when electrical power is conducted from the oscillator 8 to the 0° hybrid device 11, the 0° hybrid device distributes and supplies electrical power with the same phase to each of the 90° hybrid devices 7*a* and 7*b*. Electrical power is supplied from each of the 90° hybrid devices 7*a* and 7*b* to the feed electrodes 4*a* and 4*b*, respectively. The electrical power with the same phase is supplied to the set of feed electrodes 4*a* opposed with each other and to the set of feed electrodes 4*b* opposed with each other. The electrical power supplied to the feed electrodes 4*a* is shifted by 90° from the electrical power supplied to the feed electrodes 4*b*.

As described above, the electrical power is supplied to the feed electrodes 4*a* and 4*b* of the circularly polarized wave antenna 1 of the second embodiment. As in the first embodiment, electrical power is supplied from each of the feed electrodes 4*a* and 4*b* to a radiative electrode 3 by means of capacitive coupling. The radiative electrode 3 is excited in two directions, i.e., the $\alpha$ direction and the $\beta$ direction, as shown in FIG. 5, and performs transmission/reception of circularly polarized radio waves.

According to the second embodiment, the two sets of pairs of feed electrodes 4*a* and 4*b* are provided, which are disposed so as to oppose each other with the central axis of the dielectric member 2 therebetween. Therefore, the same advantages can be obtained as in the first embodiment. In addition, by supplying the in-phase electrical power to the set of feed electrodes 4*a* opposed with each other and to the set of feed electrodes 4*b* opposed with each other, it is possible to further increase a bandwidth in a higher mode of the circularly polarized wave antenna 1.

In the second embodiment, the feed electrodes 4*a* and 4*b* are formed on the side of the dielectric member 2. When the circularly polarized wave antenna 1 is mounted on the circuit board 13, the feed electrodes 4*a* and 4*b* of the circularly polarized wave antenna 1 can easily conduct and be connected to the circuit section formed on the back surface of the circuit board 13. Since the circuit section on the back surface of the circuit board 13 and the feed electrodes 4*a* and 4*b* of the circularly polarized wave antenna 1 conduct and are connected at the edges of the circuit board 13, patterning of the circuit section is simplified.

Figure 8:
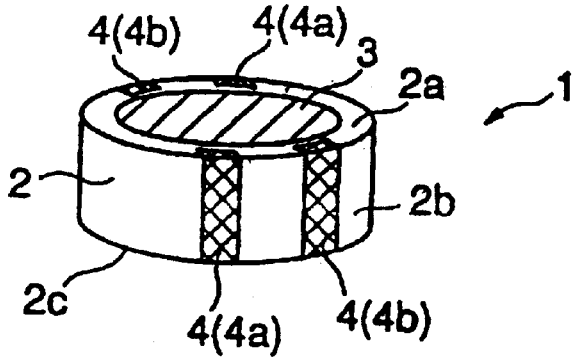
FIG. 8 is an illustration of a characteristic circularly polarized wave antenna in a third embodiment.
Figure 9:
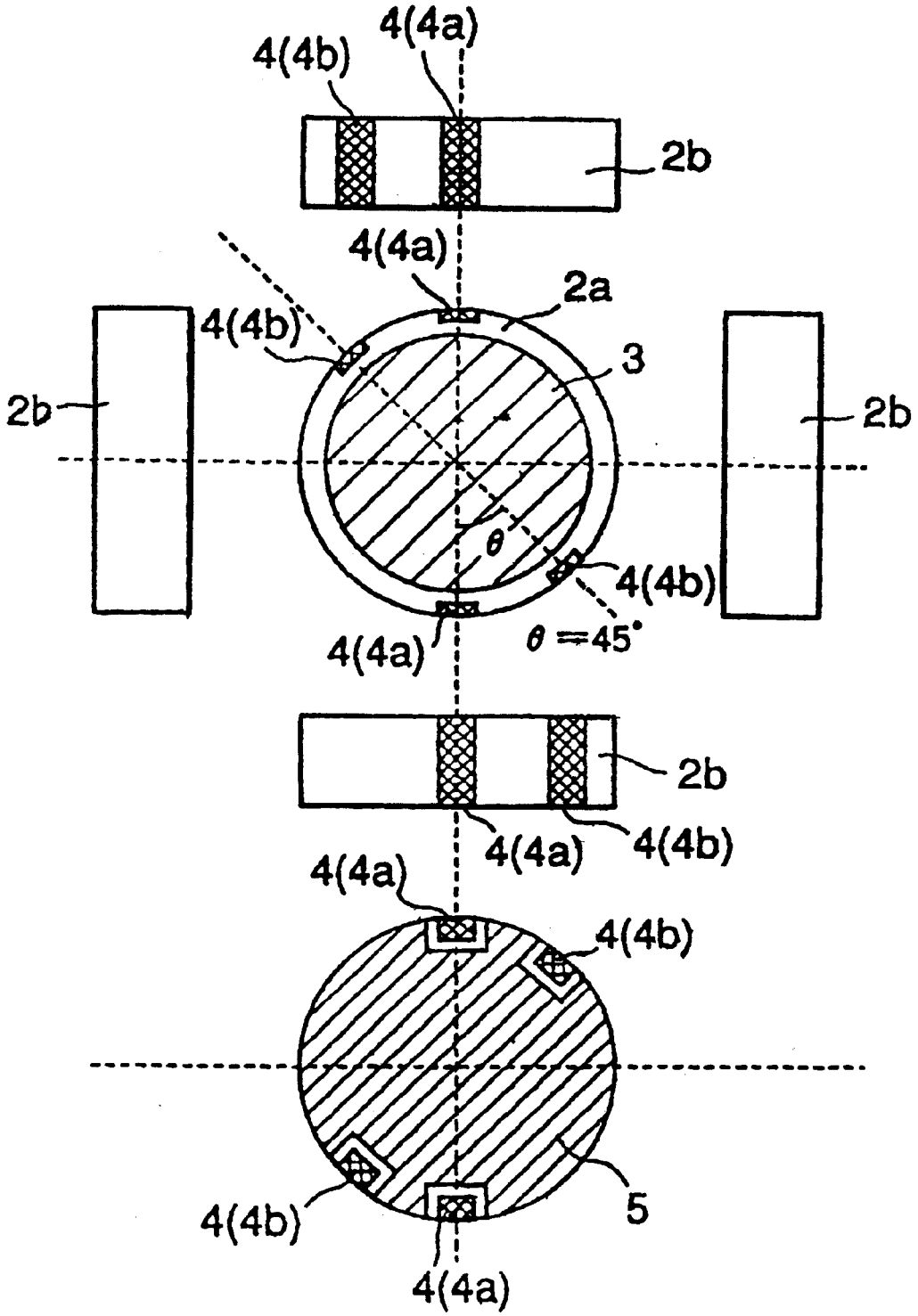
FIG. 9 illustrates states in which the circularly polarized wave antenna shown in FIG. 9 is seen from six directions, i.e., the top side, the bottom side, the front side, the back side, the left side, and the right side.

A third embodiment is described below. A characteristic feature of the third embodiment is that, as shown in FIGS. 8 and 9, feed electrodes 4*a* and 4*b* are formed so as to extend from a side 2*b* to a top surface 2*a* of a dielectric member 2. The other construction is the same as in the previous embodiments. The same reference numerals are given to the same components as in the previous embodiments, and overlapping description of the common portions is omitted.

In the third embodiment, the feed electrodes 4*a* and 4*b* are formed not only on the side 2*b* of the dielectric member 2, but also in a region between an outer peripheral edge of the top surface 2*a* of the dielectric member 2 and an edge of a radiative electrode 3 while being separated from the radiative electrode 3.

According to the third embodiment, the feed electrodes 4*a* and 4*b* are partially formed on the top surface 2*a* of the dielectric member 2. Hence, trimming of the feed electrodes 4*a* and 4*b* can be performed more easily, and therefore adjustment of the resonant frequencies of two excitation directions in the radiative electrode 3 can be performed more easily.

Figure 10A:
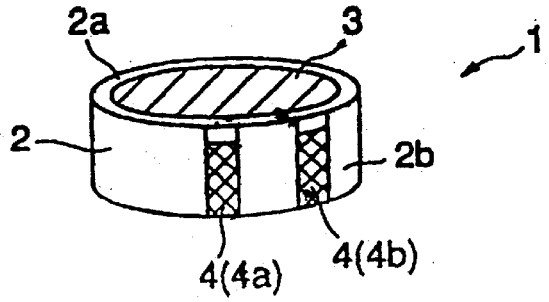
FIG. 10A and FIG. 10B include illustrations of a characteristic circularly polarized wave antenna in a fourth embodiment.
Figure 10B:
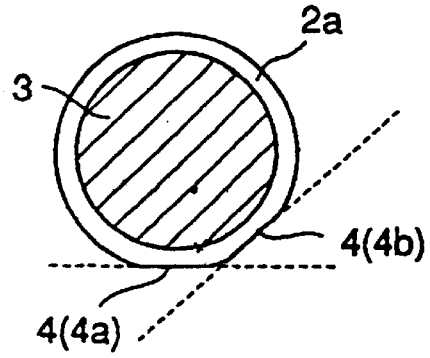

A fourth embodiment is described below. In FIG. 10A, a perspective view of a circularly polarized wave antenna according to a fourth embodiment of the present invention is shown. In FIG. 10B, a state is shown in which the circularly polarized wave antenna shown in FIG. 10A is seen from the top side.

A characteristic feature of the fourth embodiment is that, as shown in FIGS. 10A and 10B, a feed-electrode-disposing region on a side 2*b* of a dielectric member 2 is made planar. The other construction is the same as in the previous embodiments. The same reference numerals are given to the same components as in the previous embodiments, and overlapping description of the common portions is omitted.

In the fourth embodiment, as described above, the feed-electrode-disposing region on the side 2*b* of the dielectric member 2 is made planar, and feed electrodes 4 are formed on the plane by a printing technique or the like.

According to the fourth embodiment, since the feed-electrode-disposing region is made planar, there is an advantage in that it becomes much easier to form the feed electrodes 4 by a printing technique. Obviously, it is clear that the width of the feed electrodes 4 is substantially smaller than the periphery of the side of the dielectric member 2. As shown in FIG. 10(*b*), even when the feed-electrode-disposing region on the side 2*b* is made planar, the dielectric member 2 is of a substantially cylindrical shape.

Figure 11:
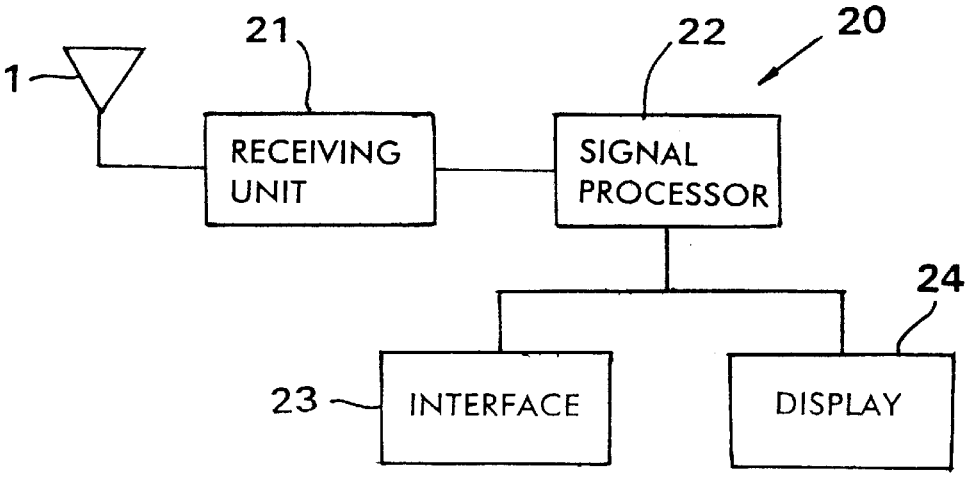
FIG. 11 is a block diagram of major components of a wireless apparatus in a fifth embodiment.
Figure 12A:
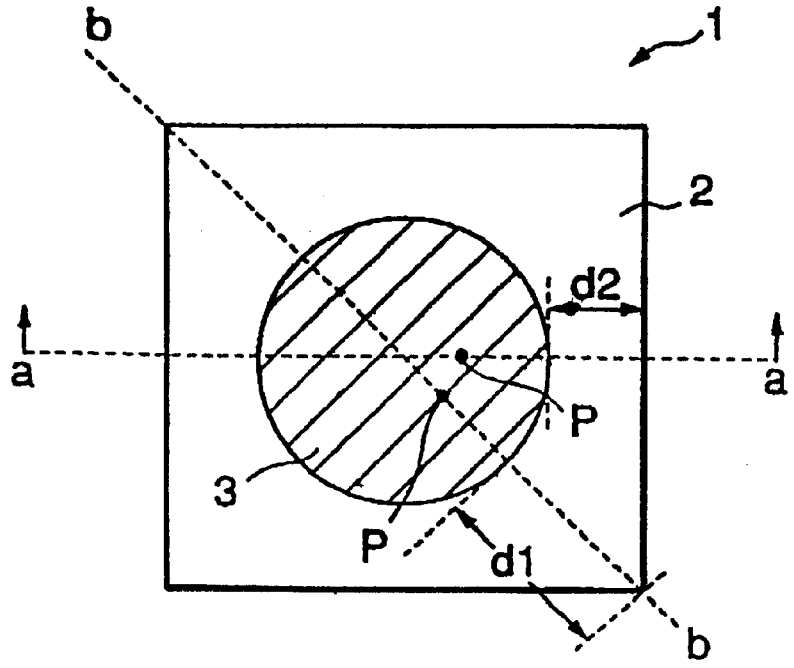
FIG. 12A PRIOR ART
FIG. 12A and FIG. 12B include illustrations of an example of a conventional circularly polarized wave antenna.
Figure 12B:
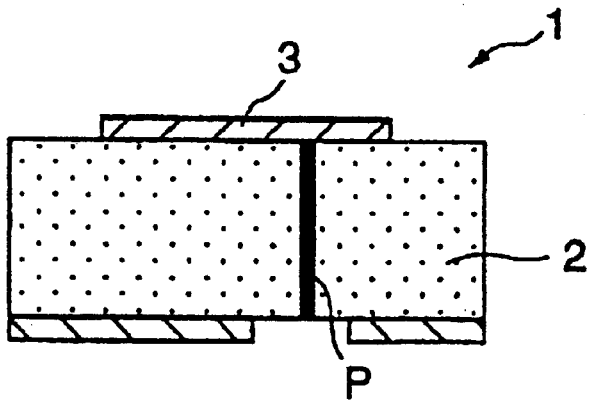
FIG. 12B PRIOR ART

A fifth embodiment is described below. In the fifth embodiment, an example of a wireless apparatus including a built-in circularly polarized wave antenna is illustrated. In FIG. 11, a block diagram of a digital audio broadcasting system as the wireless apparatus of the fifth embodiment is shown. A characteristic feature of a wireless apparatus 20 shown in FIG. 11 is that the circularly polarized wave antenna 1 of the previous embodiments is employed. In the fifth embodiment, overlapping description of the circularly polarized wave antenna 1 is omitted since the construction of the circularly polarized wave antenna 1 has been described in the previous embodiments.

As shown in FIG. 11, the wireless apparatus 20 includes the circularly polarized wave antenna 1 described in the previous embodiments, a receiving unit 21, a signal processor 22, an interface 23, such as a remote controller, and a display 24. The receiving unit 21 is connected to the circularly polarized wave antenna 1 at an input end, and to the signal processor 22 at an output end. The signal processor 22 is connected to the interface 23 and the display 24.

Radio waves received by the circularly polarized wave antenna 1 are supplied to the receiving unit 21, which isolates various predetermined signals from the supplied radio waves and outputs the signals to the signal processor 22. Based on the received signals, the signal processor 22 processes the signals, and controls the display 24 while cooperating with the interface 23, such as the remote controller.

According to the fifth embodiment, the wireless apparatus 20 includes the circularly polarized wave antenna 1 as illustrated in the previous embodiments. Therefore, the wireless apparatus 20 can obtain information at a lower error rate.

The present invention is not limited to the above embodiments and may employ various embodiments. For example, in the above embodiments, the radiative electrode 3 is formed so that the center position thereof corresponds to the center of the top surface 2*a* of the dielectric member 2. However, it is not necessary for the center of the radiative electrode 3 to correspond to the center of the top surface 2*a* of the dielectric member 2, as long as the spacing between the outer peripheral edge of the top surface 2*a* and the edge of the radiative electrode 3 is substantially the same around the entire periphery.

In the above embodiments, the dielectric member 2 is a circular cylinder. However, the dielectric member 2 may be of other shapes as long as it is substantially cylindrical. For example, the dielectric member 2 may be a polygonal column, such as a 20-sided polygonal column, or an elliptical cylinder. Alternatively, the dielectric member 2 may be substantially cylindrical in which part of the periphery of such a column is notched. It is acceptable as long as the spacing between the outer peripheral edge of the top surface 2*a* and the edge of the radiative electrode 3 is substantially the same around the entire periphery. In addition, the pattern shapes of the feed electrodes 4*a* and 4*b* and the ground electrode 5 are not limited to those in the above embodiments, and they may be of various shapes.

In the second embodiment, the example is illustrated in which the two sets of pairs of feed electrodes 4*a* and 4*b* are provided. However, three or more sets of pairs of feed electrodes 4*a* and 4*b* may be provided. The number of sets of pairs of feed electrodes 4*a* and 4*b* is not limited. Furthermore, in the second embodiment, the circuit section formed on the back surface of the circuit board 13 is formed with patterning shown in FIG. 6B. However, the patterning of the circuit section is not limited to that shown in FIG. 6B.

In the third embodiment, the feed electrodes 4*a* and 4*b* are formed so as to extend from the side 2*b* to the top surface 2*a* of the dielectric member 2. However, the feed electrodes 4*a* and 4*b* may be formed only on the top surface 2*a* of the dielectric member 2. In this case, the feed electrodes 4*a* and 4*b* of the circularly polarized wave antenna 1 conduct and are connected to the circuit section of the circuit board with a paste or the like.

In the fifth embodiment, the example is illustrated in which the digital audio broadcasting system includes the circularly polarized wave antenna 1 illustrated in the first to fourth embodiments. However, the circularly polarized wave antenna of the present invention is applicable to various wireless apparatuses. The wireless apparatus which includes the circularly polarized wave antenna of the present invention has an advantage in that it can obtain information at a lower error rate.

While the invention has been particularly shown and described with reference to preferred embodiments thereof, it will be understood by those skilled in the art that the forgoing and other changes in form and details may be made therein without departing from the spirit of the invention.

What is claimed is:

1. A circularly polarized wave antenna for transmitting/receiving circularly polarized radio waves by a radiative electrode disposed on a dielectric member, wherein:

said dielectric member is substantially cylindrical; said radiative electrode has a substantially circular shape, which is similar to a shape of a top surface of said dielectric member, and is disposed on the top surface of said dielectric member;

a spacing between an outer peripheral edge of the top surface of said dielectric member and an edge of said radiative electrode is formed so as to be substantially the same around the entirety of the outer peripheral edge of said dielectric member; and a feed electrode, which supplies electrical power to said radiative electrode by capacitive coupling, is disposed on a side of said dielectric member.

2. The circularly polarized wave antenna of claim 1, wherein: a feed-electrode-disposing region on the side of said dielectric member is formed to be planar; and said feed electrode is disposed on the plane.

3. The circularly polarized wave antenna of claim 2, wherein a plurality of feed electrodes are disposed on the plane.

4. The circularly polarized wave antenna of claim 1 wherein a plurality of feed electrodes are provided.

5. The circularly polarized wave antenna of claim 1, wherein: the edge of said radiative electrode is disposed inside the outer peripheral edge of the top surface of said dielectric member; and said feed electrode is disposed in a region between the outer peripheral edge of said dielectric member and the edge of said radiative electrode on the top surface of said dielectric member while being separated from said radiative electrode.

6. The circularly polarized wave antenna of claim 2, wherein: the edge of said radiative electrode is disposed inside the outer peripheral edge of the top surface of said dielectric member; and said feed electrode is disposed in a region between the outer peripheral edge of said dielectric member and the edge of said radiative electrode on the top surface of said dielectric member while being separated from said radiative electrode.

7. The circularly polarized wave antenna of claim 3, wherein: the edge of said radiative electrode is disposed inside the outer peripheral edge of the top surface of said dielectric member; and said feed electrode is disposed in a region between the outer peripheral edge of said dielectric member and the edge of said radiative electrode on the top surface of said dielectric member while being separated from said radiative electrode.

8. The circularly polarized wave antenna of claim 4, wherein: the edge of said radiative electrode is disposed inside the outer peripheral edge of the top surface of said dielectric member; and said feed electrode is disposed in a region between the outer peripheral edge of said dielectric member and the edge of said radiative electrode on the top surface of said dielectric member while being separated from said radiative electrode.

9. The circularly polarized wave antenna of claim 1, wherein the feed electrode is disposed on the side of the dielectric member and extends onto a bottom surface of the dielectric member.

10. The circularly polarized wave antenna of claim 1 wherein the feed electrode is disposed on the side and top and bottom surfaces of the dielectric member.

11. The circularly polarized wave antenna of claim 1, wherein said antenna has a fundamental mode and excites a mode higher than the fundamental mode.

12. The wireless apparatus of claim 1, wherein said antenna has a fundamental mode and excites a mode higher than the fundamental mode.

13. A wireless apparatus comprising a circularly polarized wave antenna, the antenna for transmitting/receiving circularly polarized radio waves by a radiative electrode disposed on a dielectric member, wherein:

said dielectric member is substantially cylindrical; said radiative electrode has a substantially circular shape, which is similar to a shape of a top surface of said dielectric member, and is disposed on the top surface of said dielectric member;

a spacing between an outer peripheral edge of the top surface of said dielectric member and an edge of said radiative electrode is formed so as to be substantially the same around the entirety of the outer peripheral edge of said dielectric member; and a feed electrode, which supplies electrical power to said radiative electrode by capacitive coupling, is disposed on a side of said dielectric member.

14. The wireless apparatus of claim 13 further wherein, a feed-electrode-disposing region on the side of said dielectric member is formed to be planar; and said feed electrode is disposed on the plane.

15. The wireless apparatus of claim 14 further wherein a plurality of feed electrodes are disposed on the plane.

16. The wireless apparatus of claim 13, wherein a plurality of feed electrodes are provided.

17. The wireless apparatus of claim 13 further wherein: the edge of said radiative electrode is disposed inside the outer peripheral edge of the top surface of said dielectric member; and said feed electrode is disposed in a region between the outer peripheral edge of said dielectric member and the edge of said radiative electrode on the top surface of said dielectric member while being separated from said radiative electrode.

18. The wireless apparatus of claim 14 further wherein: the edge of said radiative electrode is disposed inside the outer peripheral edge of the top surface of said dielectric member; and said feed electrode is disposed in a region between the outer peripheral edge of said dielectric member and the edge of said radiative electrode on the top surface of said dielectric member while being separated from said radiative electrode.

19. The wireless apparatus of claim 15 further wherein: the edge of said radiative electrode is disposed inside the outer peripheral edge of the top surface of said dielectric member; and said feed electrode is disposed in a region between the outer peripheral edge of said dielectric member and the edge of said radiative electrode on the top surface of said dielectric member while being separated from said radiative electrode.

20. The wireless apparatus of claim 16 further wherein: the edge of said radiative electrode is disposed inside the outer peripheral edge of the top surface of said dielectric member; and said feed electrode is disposed in a region between the outer peripheral edge of said dielectric member and the edge of said radiative electrode on the top surface of said dielectric member while being separated from said radiative electrode.

21. The wireless apparatus of claim 13, wherein the feed electrode is disposed on the side of the dielectric member and extends onto a bottom surface of the dielectric member.

22. The wireless apparatus of claim 13 wherein the feed electrode is disposed on the side and top and bottom surfaces of the dielectric member.

* * * * *